US008532307B2

(12) United States Patent
Derleth et al.

(10) Patent No.: US 8,532,307 B2
(45) Date of Patent: Sep. 10, 2013

(54) METHOD AND SYSTEM FOR PROVIDING BINAURAL HEARING ASSISTANCE

(75) Inventors: Ralph P. Derleth, Hinwil (CH); Stefhan Launer, Zurich (CH)

(73) Assignee: Phonak AG, Stafa (CH)

( * ) Notice: Subject to any disclaimer, the term of this patent is extended or adjusted under 35 U.S.C. 154(b) by 781 days.

(21) Appl. No.: 12/525,060

(22) PCT Filed: Jan. 30, 2007

(86) PCT No.: PCT/EP2007/000795

§ 371 (c)(1),
(2), (4) Date: Feb. 9, 2010

(87) PCT Pub. No.: WO2007/063139

PCT Pub. Date: Jun. 7, 2007

(65) Prior Publication Data

US 2010/0135500 A1 Jun. 3, 2010

(51) Int. Cl.
*H04R 25/00* (2006.01)

(52) U.S. Cl.
USPC ..... 381/23.1; 381/312; 381/313

(58) Field of Classification Search
USPC ..... 381/23.1, 315, 312, 313, 74
See application file for complete search history.

(56) References Cited

U.S. PATENT DOCUMENTS

2004/0037442 A1* 2/2004 Nielsen et al. ..... 381/315
2004/0175005 A1* 9/2004 Roeck ..... 381/74
2008/0008341 A1* 1/2008 Edwards ..... 381/315

* cited by examiner

*Primary Examiner* — Duc Nguyen
*Assistant Examiner* — Phan Le
(74) *Attorney, Agent, or Firm* — Conley Rose, P.C.

(57) ABSTRACT

A method of providing binaural hearing assistance to a user, comprising: capturing audio signals at an ear unit worn at each side of the users head; defining a target signal with regard to background noise; determining the difference in the target-signal-to-background-noise ratio of the audio signals captured at the each ear unit; exchanging audio signals between each ear unit according to the determined difference in the target-signal-to-background-noise ratio; selecting, as a function of the determined difference in the target-signal-to-background-noise ratio, as input to each of the stimulating means the audio signals captured at the respective ear unit, the audio signals received from the other one of the ear units, and/or mixtures thereof; and stimulating the user's right ear and the user's left ear according to the selected respective audio signals.

35 Claims, 4 Drawing Sheets

METHOD AND SYSTEM FOR PROVIDING BINAURAL HEARING ASSISTANCE

BACKGROUND OF THE INVENTION

1. Field of the Invention

The present invention relates to a method and a system for providing binaural hearing assistance to a user wearing a right ear unit at the right side of his head and a left ear unit at the left side of his head, with each ear unit comprising a microphone arrangement for capturing audio signals at the respective ear unit and means for stimulating the respective ear of the user, and with the ear units being capable of exchanging audio signals. Usually the ear units will be hearing aids. In most cases the stimulating means will be loudspeakers, while also other stimulating means are perceivable, such as electromechanical transducers (e.g. DACS (Direct Acoustic Cochlea Stimulation) or CI (Cochlea Implants)). According to another aspect, the invention relates to a method and a system for providing hearing assistance to a user wearing a right ear unit at the right side of his head and a left ear unit at the left side of his head, with each ear unit comprising a microphone arrangement for capturing audio signals at the respective ear unit, with one of the ear units comprising means for stimulating the respective ear of the user, and with the ear unit not having stimulating means being capable of transmitting audio signals to the other ear unit.

2. Description of Related Art

Binaural hearing aid systems are used to enhance the intelligibility of sound signals, in particular speech signals in background noise. In binaural systems both audio signals and control/status data may be exchanged between the two hearing aids, typically via a bidirectional wireless link. The exchanged audio signals may be mixed with the audio signals captured by the microphone of the respective hearing aid, for example for binaural acoustic beam-forming. Examples of such binaural systems can be found in US 2004/0252852 A1, US 2006/0245596 A1, WO 99/43185 A1, EP 1 320 281 A2 and U.S. Pat. No. 5,757,932.

According to US 2004/0252852 A1 a binaural beam-forming technique is applied wherein the left ear audio signal and the right ear audio signal are mixed prior to being reproduced by the loudspeakers of the hearing aids, with the ratio of the noise power in the right ear audio signal and the noise power in the left ear audio signal being used as a parameter for adjusting the audio signal mixing ratio. If the noise power is equal in both audio signals, the audio signals are mixed with equal weight. The mixed audio signal may be provided as a monaural signal to both ears, or mixing may occur separately for both ears.

According to US 2006/0245596 A1, binaural audio signal mixing occurs in such a manner that the captured audio signals are exchanged between the two hearing aids and that for each frequency range that signal having the higher level is reproduced at both ears. According to one embodiment, such mixing algorithm may be applied only to the frequency range of speech, whereas for other frequencies the signal is removed or is reproduced as a stereo signal.

According to WO 99/43185 A1 the binaural audio signal mixing is controlled in such a manner that for persons with a binaural hearing loss binaural sound perception is restored while taking into account the difference in hearing loss and compensation between the two ears.

According to EP 1 320 281 A2 the binaural audio signal mixing is controlled according to the presently prevailing acoustic environment and/or the time development of the acoustic environment.

According to U.S. Pat. No. 5,757,932 the binaural audio signal mixing is used for achieving binaural acoustic beam forming.

EP 1 439 732 A1 relates to a hearing aid which may be part of a binaural system and wherein the captured audio signals are split into a main path and a side path prior to being processed, with the processing of the side path resulting in smaller group delay than the processing of the main path, and with the two paths being added prior to being supplied to the loudspeaker. This method utilizes the "precedence effect", according to which the first wave front determines the spatial localization, in order to avoid localization problems due to group delay caused by signal processing in the frequency-domain.

Further, it is known to use so-called "CROS" or "BICROS" systems for aiding single sided deaf persons, i.e. persons having a very asymmetric hearing loss. In such systems audio signals captured at the deaf ear are transmitted to the better ear in order to be reproduced by a loudspeaker to the better ear. If necessary, the better ear will be aided by a hearing aid, in which case the audio signals transmitted from the deaf ear are combined with the audio signals captured at the better ear prior to being reproduced by the loudspeaker at the better ear.

It is a first object of the invention to provide for a method and a system for providing binaural hearing assistance, wherein the perception of target audio signals in background noise should be improved, in particular for hearing impaired persons.

It is a second object of the invention to provide for a method and a system for providing hearing assistance to persons suffering from severe strongly asymmetric hearing loss, wherein the perception of target audio signals in background noise should be improved.

SUMMARY OF THE INVENTION

According to one aspect of the invention a desired target signal is defined and the audio signals received from the other one of the ear unit via audio signal exchange and/or mixtures of these audio signals are selected, as a function of the determined difference in the target-signal-to-background-noise ratio of the audio signals captured at the right ear unit and the audio signals captured at the left ear unit, as input to each of the stimulating means the audio signals captured at the respective ear unit. Thereby the perception of target signals, e.g. speech, in noisy environments can be enhanced in asymmetric hearing situations, i.e. in situations in which different sound signals reach the two ears of a person. This applies in particular if the user is hearing impaired.

According to one aspect of the invention a desired target signal is defined and the audio signals received from the other one of the ear unit via audio signal exchange and/or mixtures of these audio signals are selected, as a function of the determined difference in the target-signal-to-background-noise ratio of the audio signals captured at the right ear unit and the audio signals captured at the left ear unit, as input to the stimulating means the audio signals captured at the respective ear unit. Thereby the perception of target signals, e.g. speech, in noisy environments can be enhanced in asymmetric hearing situations, i.e. in situations in which different sound signals reach the two ears of a person.

The acoustic world with respect to a person using a hearing assistance system most of the time is asymmetric, since in most of the situations the signals reaching the two ears of the user will be different. Consequently, usually at a given moment in time one ear will receive a mixture of a desired target sound (such as the voice of a speaker speaking to the user) and distracter sound (i.e. acoustic background noise) which is favorable with respect to the target-signal-to-background-noise ratio (in the following referred to as "signal to noise ratio" (SNR)) over the signal on the other ear. However, this favorable signal will change from one side to the other with time and may also be different in different sub-bands of the auditory frequency range. The main reasons for such changes of the side of the favorable signal in time and in frequency are movements of the head of the user, changes in the position of the user in space, changes of the positions of the sound sources in space and intermittent activity of spatially distributed sound sources. Thus, at a given point in time and in a given frequency band an acoustic signal exists, which can be labeled "better" with respect to SNR at one of the user's ears compared to the other one. While for normal hearing persons or persons with mild symmetrical hearing losses it can be assumed that the "better" sub-band signals on either ear can be perceptually combined ("exploiting the better-ear-effect"), this may not be the case for persons suffering from severe symmetric hearing loss or strongly asymmetric hearing loss.

The present invention enables to restore the reduced or lost ability of hearing impaired persons to exploit the "better ear effect" by monitoring the binaural difference in SNR and thereby allowing to supply sound signal parts which have a clearly better SNR at one of the ears to both ears, whereby the chance of the target signal extraction is enhanced. Preferred embodiments of the invention are defined in the dependent claims.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
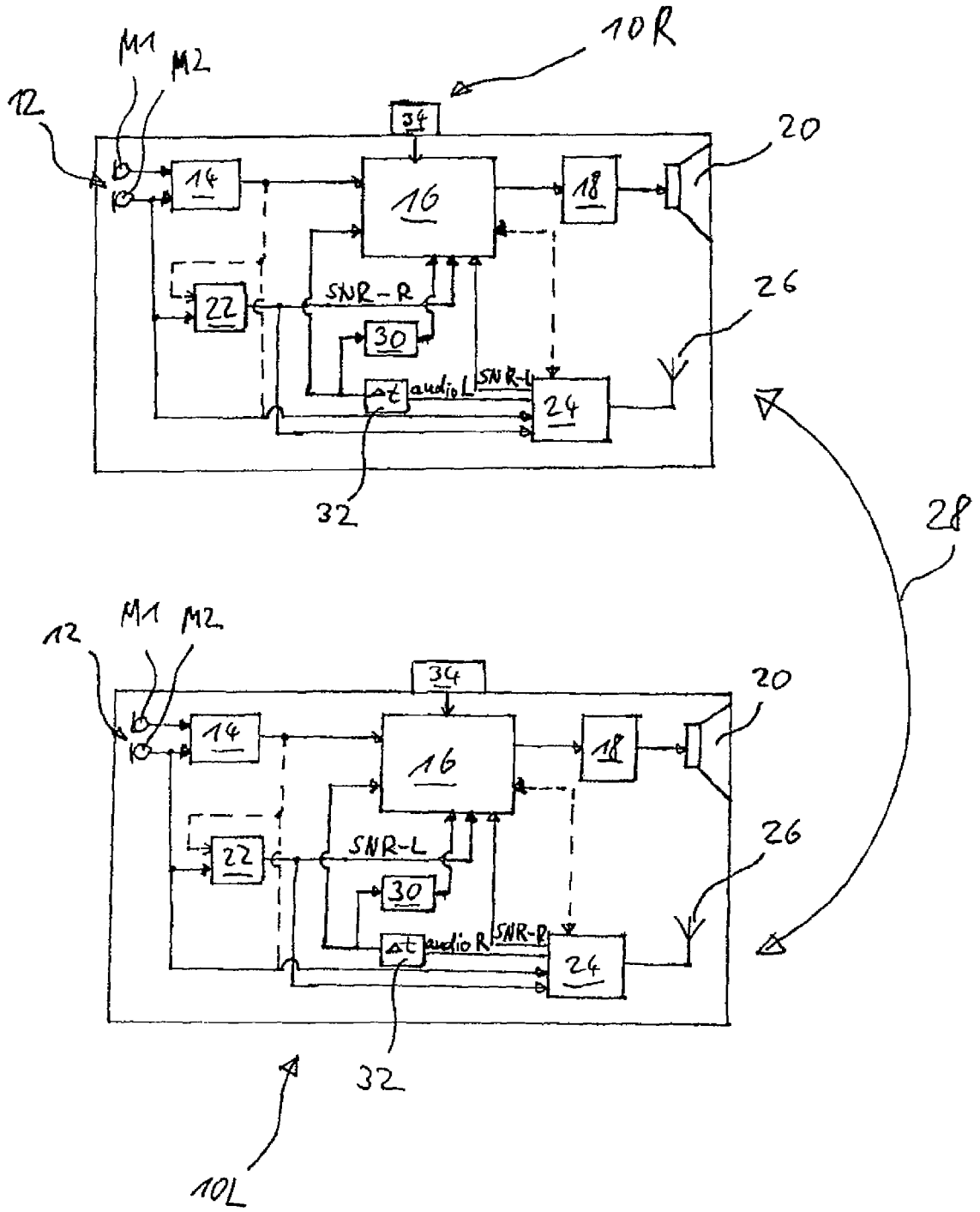
FIG. 1 is a block diagram of an example of a binaural hearing assistance system according to the invention.

The binaural hearing assistance system of FIG. 1 comprises a right ear unit 10R to be worn at or at least in part in a user's right ear and a left ear unit 10L to be worn at or at least in part in the user's left ear. Usually the units 10R and 10L will be hearing aids, such as of the BTE (Behind-The-Ear) type, ITE (In-The-Ear) type or CIC (Completely-In-the-Canal) type. The units 10R and 10L typically will have the same structure/architecture. In the example shown in FIG. 1 each unit 10R, 10L comprises a microphone arrangement 12 for capturing audio signals from sound received at the respective ear at which the unit is worn, an input audio signal processing unit 14 for processing the audio signals captured by the microphone arrangement 12, a central unit 16, a loudspeaker 20 for stimulating the respective ear at which the ear unit 10R, 10L is worn, an output audio signal processing unit 18 for processing the audio signals supplied by the central unit 16 as input to the loudspeaker 20, a unit 22 for estimating the SNR of the audio signals captured by the microphone arrangement 12, a transceiver 24 and an antenna 26 for establishing a bidirectional wireless link 28 between the ear units 10R, 10L, a unit 30 for estimating the SNR of audio signals received by the transceiver 24 from the other one of the ear units 10R, 10L, and a signal delaying unit 32 for delaying the audio signals received by the transceiver 24.

The microphone arrangement 12 may comprise at least two spaced apart omnidirectional microphones M1 and M2 in order to provide for monaural acoustic beam-forming capability. In this case the input audio signal processing unit 14 may include a beam-former. Alternatively, the microphones M1 and M2 may be directional. In this case it may be preferable to use the output of the unit 14 as input to the SNR estimation unit 22.

The SNR estimation in the unit 22 may be based on the audio signals already having been processed by the unit 14 and/or on the audio signals as captured by one of the omnidirectional microphones M1, M2.

The SNR estimation units 22 and 30 are designed to estimate the ratio of a pre-defined target signal to background noise. To this end, the SNR estimation units 22 and 30 are optimized with regard to the typical spectral features and the typical time domain features of the defined target signal. Accordingly, the SNR estimation units 22 and 30 may analyze the modulation spectrum, the harmonic properties, the presence and value of a typical base frequency modulation, structures of the characteristic frequencies, etc.

For example, the target signal may be defined as a voice, i.e. speech, signal. Speech signals typically are amplitude modulated in the time domain with modulation frequencies in the range of 0.5 to 12 Hz, with a maximum modulation around 4 Hz (syllable frequency). Accordingly, the SNR estimation unit in this case may have time constants of the time averaging which are selected such that a signal comprising amplitude modulations around 4 Hz will result in high estimation value whereas non-modulated signals, e.g. a pure sine tone, will result in a low estimation value. The target signal may be defined as the voice signal having the highest amplitude/power among other voice signals in order enhance the intelligibility of the voice of a person presently speaking to the user with regard to background voices from other persons.

In certain situations, e.g. in a concert hall, the target signal may defined as a typical music signal. Music signals may be recognized due to their broad spectra and their high level variations.

The target signal may be defined by the user. For example, the user may select the target signal, i.e. the type of target signal from a plurality of pre-defined target signals (e.g. speech in general, certain types of speech, music in general, certain types of music, etc.). To this end, the ear units 10R, 10L comprise means for selecting/defining the target signal. This may occur by recognition of voice commands by the user on the central unit 16 and/or by a manually operable control element 34 provided at least one of the ear units 10R, 10L. The system may have a default setting for the target signal, for example speech, which may be changed by the user according to his present preference.

The SNR estimation units 22 and 30 may be relatively simple, for example, peak-and-valley estimators (which estimate the signal dynamics of the envelope within a typical modulation frequency range). Examples for SNR estimators to be used with the present invention can found in and the (auditory scene) classification literature and the noise canceling literature which is concerned with the object of providing a method for estimating from the statistic features of a defined target signal (usually speech) the proportion of this target signal a given mixture of that target signal and a distractor signal. As an example for such methods one may refer to Peter Vary and Rainer Martin, Digital Speech Transmission, Wiley 2006, ISBN 0-471-56018-9, Chapter 11, Single and Dual Channel Noise Reduction.

In view of the fact that the present invention utilizes only the difference in SNR between the two ears, the SNR estimation on either ear need not to be very accurate, since only the SNR difference derived from the SNR estimates has to be reliable and fast enough to adapt to sound field changes introduced by movements of the head of the user or by changes of the sound source positions. Also the needed time resolution (in the range of 100 msec) is low. However, the SNR estimation on either side should not be affected by quickly self-adjusting signal processing means like adaptive beam forming.

The transceiver 24 may be used for transmitting the SNR estimation of the unit 22 and the audio signal captured by the microphone arrangement 12, either as captured by one of the omnidirectional microphones M1, M2 or after having been processed by the input audio signal processing unit 14 via the link 28 to the transceiver 24 of the other ear unit. In turn the transceiver 24 receives the audio signals captured by the microphone arrangement 12 of the other one of the ear units and the respective SNR estimation of the unit 22 of the other one of the ear units 10R, 10L, i.e. the SNR estimation regarding the audio signals captured by the other one of the ear units. The SNR estimation of the unit 22 and the SNR estimation received by the transceiver 24 both are supplied to the central unit 16 in which the respective SNR difference is determined. Alternatively or in addition to the received SNR estimation the SNR estimation of the unit 30 based on the audio signals received by the transceiver 24 may be supplied to the central unit 16. The audio signals received by the transceiver 24 may undergo a signal delay in the signal delay unit 32 prior to being supplied as input to the central unit 16.

The central unit 16 on the one hand serves to control, as a function of the SNR difference determined in the central unit 16, the mixing of the audio signals captured by the microphone arrangement 12 and the audio signals received by the transceiver 24 prior to being supplied as input to the loudspeaker 20 via the output audio signal processing unit 18. On the other hand the central serves to control operation of other units of the ear unit 10R, 10L, such as the transceiver 24, the audio signal processing units 14 and 18, the SNR estimation units 22 and 30 and the signal delay unit 32.

In the following, examples of processing schemes to be carried out by the central unit 16 will be illustrated by reference to FIGS. 2 to 4. In the processing schemes shown in FIGS. 2 to 4 one of the ears/ears units is denoted "ipsi-lateral" or "ipsi" or as the other ear/ear unit is denotes as "contra-lateral" or "contra".

Preferably the processing scheme is carried out separately in each frequency sub-band of the captured audio signals, i.e. the audio signals captured by the microphone arrangement 12 are split into a plurality of sub-bands, for example, 20 sub-bands, covering the auditory frequency range, and the processing scheme is applied to each sub-band separately, with the sub-bands being processed essentially in parallel. In general, sub-band audio signal processing is a standard procedure in digital hearing aids. In FIGS. 2 to 4 the respective processing scheme is shown for one sub-band.

Figure 2:
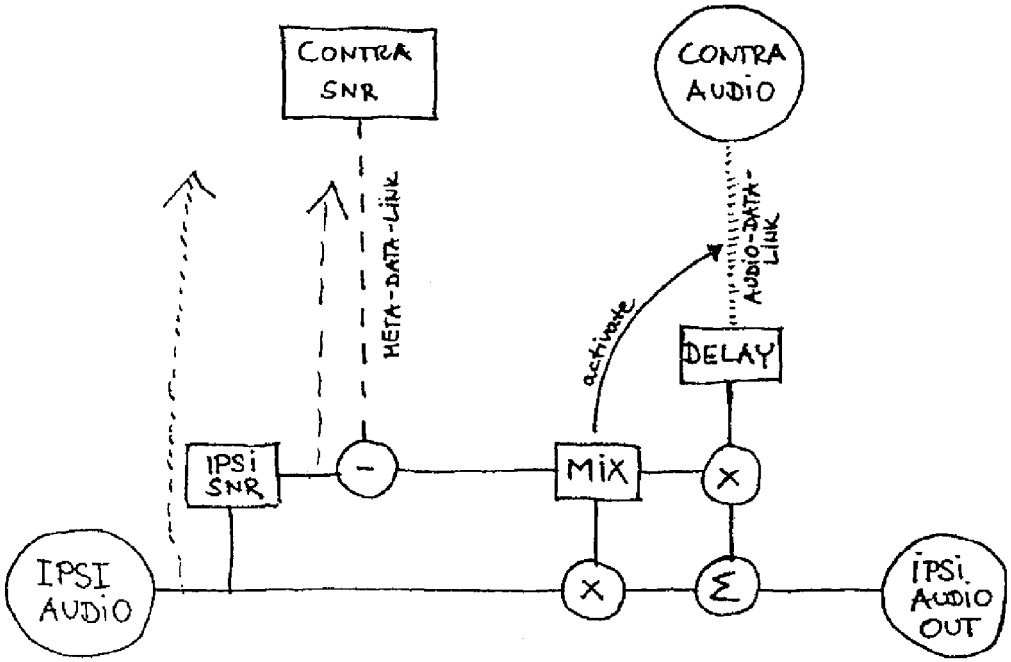
FIG. 2 is a schematic representation of an example of a processing scheme to be used in the system of FIG. 1.

According to the processing scheme of FIG. 2 the SNR estimation ("ipsi SNR") of the audio signals ("ipsi audio") captured by the microphone arrangement 12 of the respective ear unit is performed separately in each of the ear units, and the SNR estimations ("ipsi SNR" and "contra SNR") are exchanged between the ear units (for example, via a "meta-data-link", which may be physically realized by the digital binaural link 28). In each ear unit the SNR difference is calculated separately, as indicated by the minus-sign in FIG. 2. Depending on a decision criterion taking into account the calculated SNR difference, the exchange of audio data ("contra audio") via an audio link ("audio-data-link", which may be realized by the binaural digital link 28) will be activated (by "MIX") so that audio signals ("contra audio") captured by the microphone arrangement 12 of the other ear unit are received. Activation of the audio signal exchange may occur by exchanging a corresponding request between the ear units. Correspondingly, "ipsi" audio signals will be transmitted to the "contra" ear unit upon an activation request by the "contra" ear unit. The "audio data link" will be active as long as there is in at least one sub-band a request for audio signal exchange.

A certain delay (typically 0.5 to 5 ms) will be applied to the exchanged audio signals in order to exploit the lateralization ability of the human binaural hearing ("precedence effect"). Preferably the delay can be adjusted to achieve the individually desired degree of lateralization. The selection of the delay time also has to take into account the signal delay inherently caused by the audio data link.

Depending on the calculated SNR difference the output of the processing scheme of FIG. 2 ("ipsi audio out") will be selected from the captured audio signals ("ipsi audio") and the received audio signals ("contra audio") and mixtures thereof according to a given mixing function, i.e. the output signal will be a weighted combination of "ipsi audio" and "contra audio", wherein the respective weights may vary from 0 to 1 as a function of the calculated SNR difference. This signal combining is indicated in FIG. 2 by the two elements "x" and the element "Σ". The "ipsi audio out" signal may undergo further audio signal processing, such as beam forming or noise canceling, and finally is supplied to the loudspeaker 20 for being reproduced to the "ipsi ear" of the user.

Figure 4:
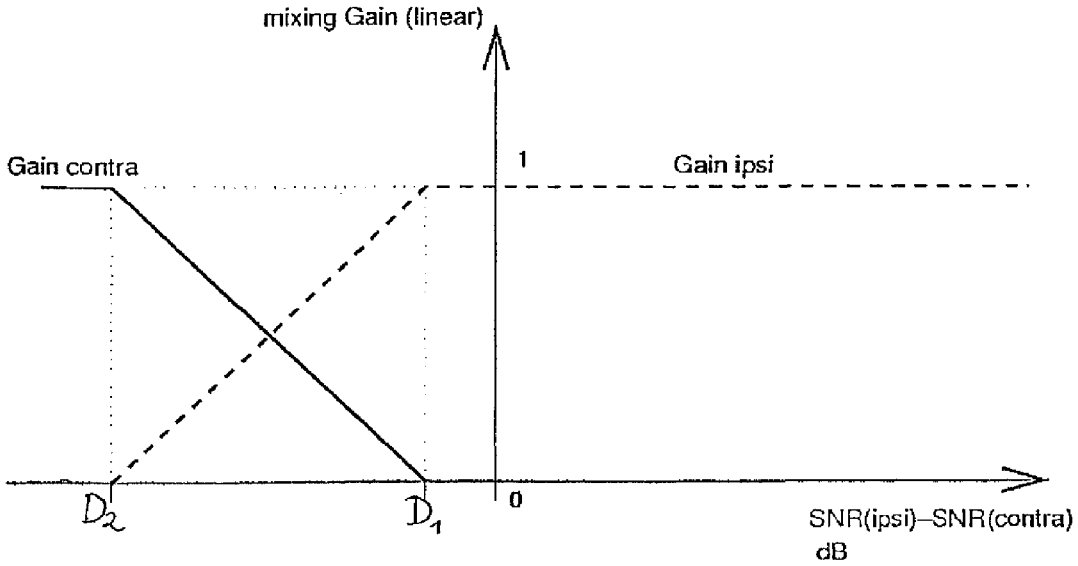
FIG. 4 is an example of an audio signal mixing function to be used in processing schemes of FIGS. 2 and 3.

An example of such a mixing function is shown in FIG. 4 wherein the weights of the ipsi signal and the contra signal are shown as a function of the SNR difference (SNR (ipsi)—SNR (contra)) in dB. For a positive value of this SNR difference the ipsi side is the "better ear", whereas for a negative SNR difference the contra side is the "better ear". Consequently, for positive values of the SNR difference—and also for moderately negative values above a first threshold value $D_1$—the weight of the contra signal is zero, i.e. the output signal will consist exclusively of the ipsi audio signals. For strongly negative values of the SNR difference, i.e. for values below a second threshold $D_2$, the weight of the contra signal will be one so that the ipsi audio output will consist exclusively of the received contra audio signals which have a considerably better SNR. For values of the SNR difference between $D_1$ and $D_2$ the contra audio signals are admixed with increasing weight for decreasing values of the SNR difference until $D_2$ is reached. Of course, different mixing functions may used depending on the individual hearing loss, the individual preferences and the respective frequency sub-band.

The threshold value for activation of the audio signal exchange may be selected to be around a SNR difference of 0 dB.

Figure 3:
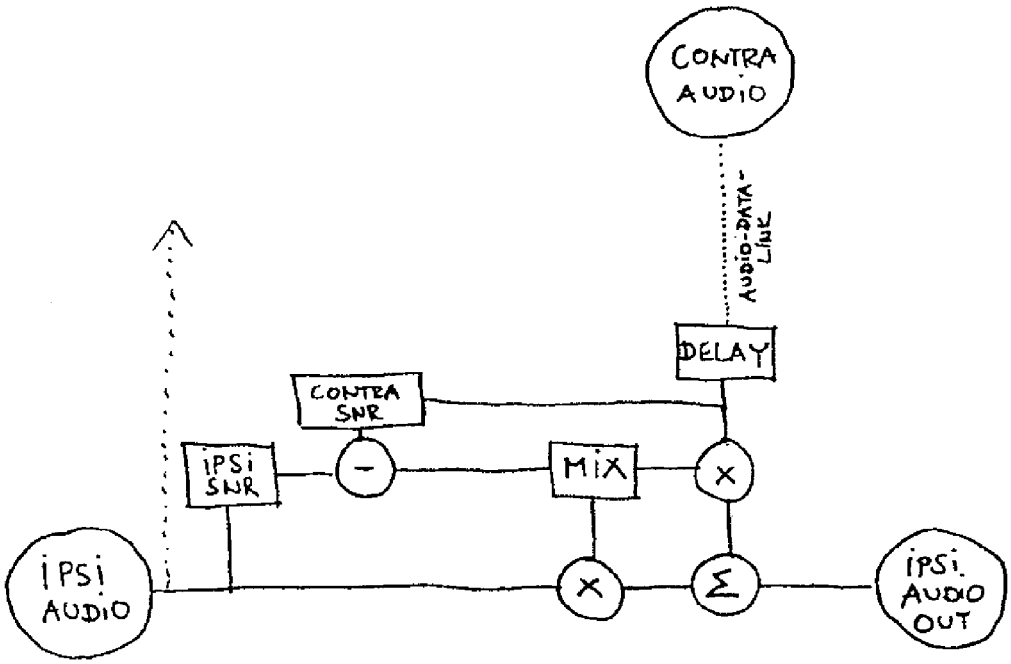
FIG. 3 is another example of a processing scheme to be used in the system of FIG. 1.

FIG. 3 shows a processing scheme which differs from that of FIG. 2 in that in addition to estimating the SNR of the "ipsi" audio signals each ear unit in addition determines the SNR estimation of the "contra" audio signals, so that no exchange of the SNR estimations between the ear units is necessary.

However, such processing is possible only if the audio signal exchange between the ear units is active so that each ear unit receives the audio signals captured by the other ear unit for determining the SNR estimation. The SNR estimation of the received audio signals is indicated by "contra SNR" in FIG. 3. The processing scheme of FIG. 3 may be permanently used in systems in which there is permanently an audio signal exchange, or it may be temporarily used in systems with audio link activation during the times in which the audio signal exchange is active.

By adjusting the mixing function in an appropriate manner the desired increase of the SNR on the "worse ear" and the undesired modification of "natural localization cues", which both effects may result from the binaural audio signal exchange, may be traded in such a manner that the overall effect is perceptually convenient to the individual user.

In general, the processing schemes shown in FIGS. 2 and 3 may be combined with any known signal processing method and thus offers additional benefit on top of such processing methods.

As already mentioned above, preferably the exchange of audio signals is activated only during times when there is a "better ear situation" and thus need not be active all the time. A sudden loss of the audio link will automatically result in classical bilateral operation of the system and will be perceptually inconspicuous. In general, the processing scheme of FIGS. 2 and 3 improve the perceived SNR in many asymmetric acoustic situations while it will be inaudible in symmetric acoustic situations without need for manual deactivation.

The processing scheme in addition may act as a binaural feedback canceller at no extra costs as long as the SNR estimators on either side estimate a tonal signal as having a low SNR. In general, if operation as a binaural feedback canceller is desired, one has to ensure that feedback-like signals are sensed and the mixing is adjusted accordingly to reduce the tonal component on one side. Similarly to such feedback cancelling operation, any kind of asymmetric acoustic condition could be treated in this way, for example wind-noise cancelling.

Tests with ten hearing impaired persons have shown on average an improvement of about 1.8 dB SRT (Speech Recognition Threshold) in acoustically complex situations (diffuse cafeteria noise with a single speaker as the target signal) using commonly available SNR estimators (with the tested setup the theoretical optimum SRT improvement would have been 3.5 dB if perfect a priori SNR information would be available).

The method according the invention results in a number of benefits compared to classical binaural beam forming techniques.

For example, the method according to the invention results in much less sensitive characteristics with regard to head movements or sound source movements compared to binaural beam forming techniques. Rather, the method of the invention provides for characteristics similar to the natural characteristics. Thus, the user—in contrast to the application of binaural beam forming techniques—does not have to accurately focus the desired sound source (for example a person speaking to him).

The quality of the exchanged audio signals can be low with respect to binaural beam forming, since the processing according to the invention is not phase-sensitive or jitter-sensitive. The processing is computationally cheap compared to binaural beam-forming, since no explicit phase calculations are needed.

The need for microphone calibration between the two ear units is not existent at all, whereas classical binaural beam forming has to rely heavily on the accurate phase and level matching between the microphones. In practice, for binaural beam-forming the initial microphone matching during manufacturing and the monitoring during long term operation of the system are complex and costly with respect to logistics, time, processing power and system complexity.

The signal delay introduced by the audio link between the two ear units need not be compensated fully, since, as already mentioned above, a remaining delay in the range of 0.5 to 5 ms is acoustically favorable in order to exploit the precedence effect and allows for a "close to natural" lateralization. Being not forced to compensate for an audio link delay allows for a smaller overall system delay, which is favorable for acoustical reasons, such as sound quality in general, feedback, interaction of vision and hearing, etc.

There is no need for any kind of "roll-off" compensation like in all beam forming techniques.

Whereas it has been described in detail how the input to each of the stimulating means may be selected automatically as a function of the determined difference in the target-signal-to-background-noise ratio, in certain situations it may desirable for the user to manually override this automatic selection at least for a certain frequency range. For example, in a situation in which there is one person at the right side of the user and a second person at the left side of the user, with both persons speaking more or less simultaneously, the automatic selection would result in both voices being reproduced to the user at more or less equal level. If the user wishes to listen only to one of the tow persons, he may override that automatic selection in order to have the voice of the desired person enhanced with regard to the voice of the non-desired person. To this end, the user may select the presently preferred side, e.g. by manually operating the control element 34 of the ear unit 10R, 10L located on presently the preferred side, in order to achieve that exclusively (or primarily) the audio signals captured by the microphone arrangement 12 of the selected one of the ear units 10R, 10L is supplied as input to the loudspeaker 20 of both ear units 10R, 10L.

In addition, the automatic selection of the input to each of the stimulating means as a function of the determined difference in the target-signal-to-background-noise ratio may be assisted or may be overridden by an optical system capable of recognizing persons likely to speak to the user. For example, the system may comprise a camera and a unit capable of recognizing the presence of a person, e.g. by recognizing the presence of a face, from the images taken by the camera, with the output of the recognizing unit being supplied to the ear units 10R, 10L in order to take into account the presence and position (right/left) of a person when selecting the input to the loudspeakers 20. Such an optical system may be formed realized by a mobile phone worn in a chest pocket of the user, which comprises a camera and on which a simple face recognition algorithm is run, with the output of the face recognition algorithm being provided wirelessly to the ear units 10R, 10L, e.g. via the transceivers 24.

Figure 5:
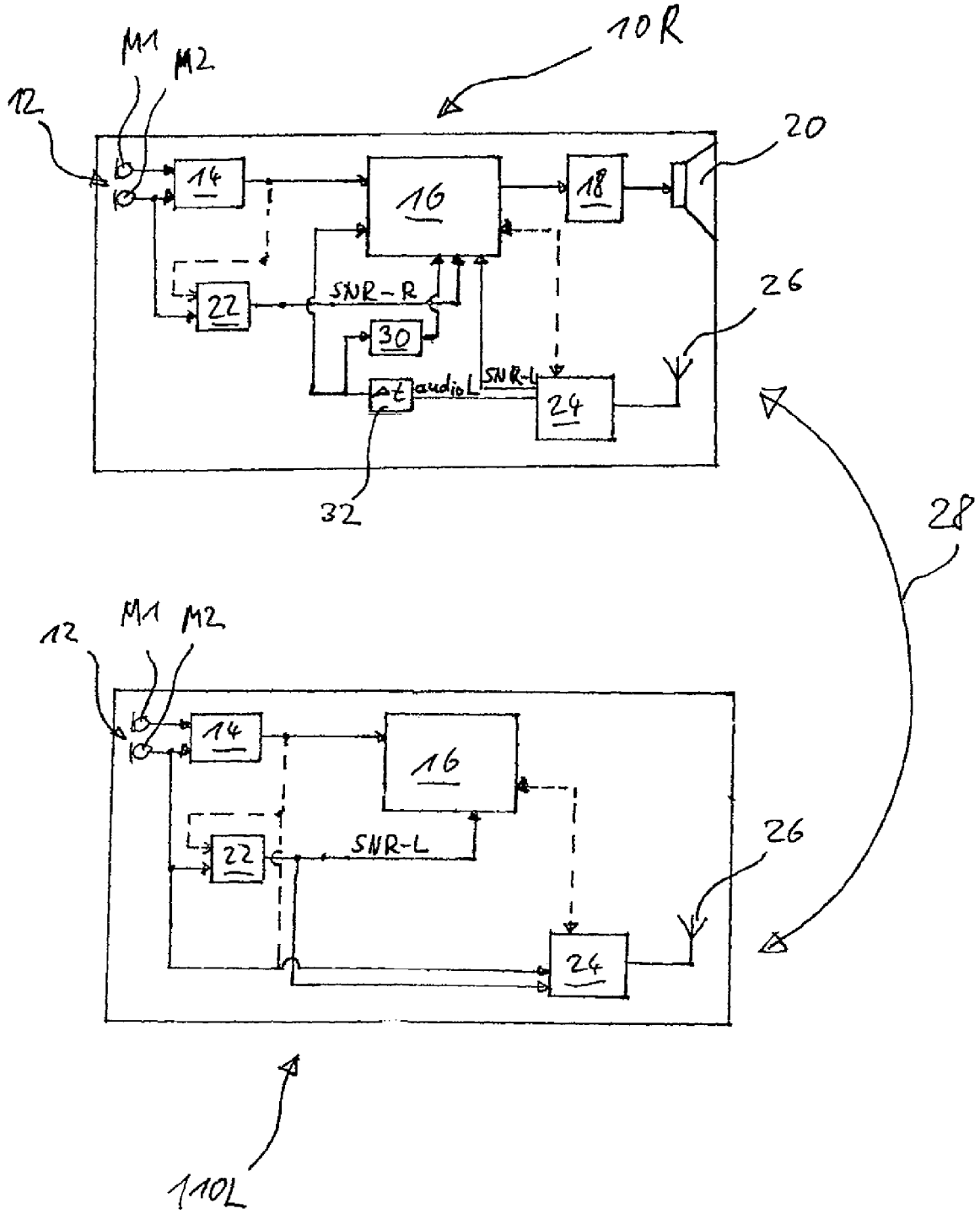
FIG. 5 is a block diagram of an example of a hearing assistance system according to the invention for users suffering from severe strongly asymmetric hearing loss.

In FIG. 5 an example of a hearing assistance system is shown which is appropriate for users suffering from severe strongly asymmetric hearing loss, e.g. for persons with one deaf ear. The main modification with regard to the system of FIG. 1 is that that one of the ear units (110L in the example of FIG. 5) is not capable of reproducing sound but rather primarily serves as a remote microphone for the other ear unit (10R in the example of FIG. 5). Thus, no audio signals need to be transmitted from the right ear unit 10R to the left ear unit 110L. Whereas according to FIG. 5 the left ear unit 110L is provided with an SNR estimation unit 22, this SNR estimation unit 22 could be omitted if the SNR estimation for the audio signals captured at the left ear unit 110L is performed in the right ear unit 10R in the SNR estimation unit 22 on the audio signals received via the link 28.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A method of providing binaural hearing assistance to a user, comprising:

capturing audio signals at a right ear unit which is worn at the right side of a user's head and which comprises means for stimulating a user's right ear;

simultaneously capturing audio signals at a left ear unit which is worn at the left side of the user's head and which comprises means for stimulating a user's left ear;

defining a target signal with regard to background noise;

determining a difference in a target-signal-to-background-noise ratio of the audio signals captured at the right ear unit and the audio signals captured at the left ear unit;

exchanging audio signals between the right ear unit and the left ear unit according to the determined difference in the target-signal-to-background-noise ratio;

selecting, as a function of the determined difference in the target-signal-to-background-noise ratio, as input to each of the stimulating means at least one of the audio signals captured at the respective ear unit, the audio signals received from the other one of the ear units, and mixtures thereof;

stimulating the user's right ear and the user's left ear according to the selected respective audio signals; and wherein the exchanged audio signals are delayed by 0.5 to 5 ms relative to the ear unit receiving the exchanged audio signals;

wherein, if the difference in the target-signal-to-background-noise ratio exceeds a first pre-defined threshold value, audio signals are exchanged from that one of the ear units at which the captured audio signals have a better target-signal-to-background-noise ratio to the other one of the ear units and the audio signals having the better target-signal-to-background-noise ratio are selected as the input to the stimulating means of both ear units; and wherein, if the difference in the target-signal-to-background-noise ratio is between said first threshold value and a second pre-defined threshold value, audio signals are exchanged from that one of the ear units at which the captured audio signals have a better target-signal-to-background-noise ratio to the other one of the ear units and a mixture of the exchanged audio signals and the audio signals captured at that one of the ear units at which the captured audio signals have the better target-signal-to-background-noise ratio are selected as the input to the stimulating means of that one of the ear units.

2. The method of claim 1, wherein, if the difference in the target-signal-to-background-noise ratio is between said first and said second pre-defined threshold values, the audio signals captured at that one of the ear units at which the captured audio signals have the better target-signal-to-background-noise ratio are selected as the input to the stimulating means of that one of the ear units.

3. The method of claim 1, wherein in said mixture of the audio signals a weight of the transmitted audio signals increases with increasing determined difference in target-signal-to-background-noise ratio as a monotonous function.

4. The method of claim 1, wherein, if the difference in the target-signal-to-background-noise ratio is below said second pre-defined threshold value, the audio signals captured at each of the ear units are selected as the input to the stimulating means of the same ear unit.

5. The method of claim 1, wherein, once the determined difference in the target-signal-to-background-noise ratio exceeds a pre-defined threshold value, said exchange of audio signals is activated.

6. The method of claim 1, wherein the target-signal-to-background-noise ratio of the audio signals is permanently determined by the respective ear unit at which the audio signals are captured, and wherein the determined target-signal-to-background-noise ratio is permanently transmitted to the other one of the ear units.

7. The method of claim 5, wherein during times when said exchange of audio signals is not activated, the target-signal-to-background-noise ratio of the audio signals is determined by that ear unit at which the audio signals are captured, wherein the determined target-signal-to-background-noise ratio is transmitted to the other one of the ear units, whereas during times when said exchange of audio signals is activated each ear unit determines the target-signal-to-background-noise ratio of the audio signals captured by that ear unit and the target-signal-to-background-noise ratio of the audio signals received from the other one of the ear units, with no data regarding the determined target-signal-to-background-noise ratios of the audio signals being exchanged.

8. The method of claim 1, wherein the audio signals captured at the right ear unit and the audio signals captured at the left ear unit are processed before said determining of the difference in the target-signal-to-background-noise ratio is carried out.

9. The method of claim 7, wherein said determining of the difference in the target-signal-to-background-noise ratio is carried out on the audio signals as captured by at least one omni-directional microphone at the right ear unit and the left ear unit, respectively.

10. The method of claim 1, wherein the audio signals captured at the right ear unit and the audio signals captured at the left ear unit are processed before being used for stimulating the respective ear and before being transmitted to the other ear unit, respectively.

11. The method of claim 1, wherein the selected audio signals are processed prior to being used for stimulation.

12. The method of claim 1, wherein said exchanging of audio signals is carried out via a wireless link.

13. The method of claim 12, wherein said wireless link is digital.

14. The method of claim 1, wherein said delay time is individually adjusted.

15. The method of claim 1, wherein the captured audio signals are split into a plurality of frequency bands and wherein said method is carried out in each of said separate frequency bands.

16. The method of claim 1, wherein the target signal is defined as a voice signal.

17. The method of claim 16, wherein the target signal is defined as the voice signal having the highest amplitude/power among other voice signals.

18. The method of claim 1, wherein the target signal is defined as a music signal.

19. The method of claim 1, wherein the target signal is defined by the user.

20. The method of claim 1, wherein the target signal is selected by the user from a plurality of pre-defined target signals.

21. The method of claim 1, wherein said selecting of the input to each of the stimulating means as a function of the determined difference in the target-signal-to-background-noise ratio can be overridden by the user at least for a certain frequency range.

22. The method of claim 1, wherein said selecting of the input to each of the stimulating means as a function of the determined difference in the target-signal-to-background-noise ratio is assisted or can be overridden by an optical system capable of recognizing persons likely to speak to the user.

23. The method of claim 1, wherein the right ear unit is worn at or at least in part in the user's right ear and the left ear unit is worn at or at least in part in the user's left ear.

24. A method of providing hearing assistance to a user, comprising:

capturing audio signals at a right ear unit which is worn at the right side of a user's head and simultaneously capturing audio signals at a left ear unit which is worn at a left side of the user's head, with one of the right ear unit and the left ear unit comprising means for stimulating a user's respective ear;

defining a target signal with regard to background noise;

determining a difference in the target-signal-to-background-noise ratio of the audio signals captured at the right ear unit and the audio signals captured at the left ear unit;

transmitting, according to the determined difference in the target-signal-to-background-noise ratio, audio signals from that one of the ear units not comprising stimulating means to that one of the ear units comprising the stimulating means, wherein the transmitted audio signals are delayed by 0.5 to 5 ms relative to the ear unit receiving the transmitted audio signals;

selecting, as a function of the determined difference in the target-signal-to-background-noise ratio, as input to the stimulating means at least one of the audio signals captured at the respective ear unit, the audio signals received from the other one of the ear units, and mixtures thereof; and stimulating the user's respective ear according to the selected respective audio signals and wherein, if the difference in the target-signal-to-background-noise ratio exceeds a first pre-defined threshold value, audio signals are transmitted from that one of the ear units at which the captured audio signals have a better target-signal-to-background-noise ratio to the other one of the ear units and the audio signals having the better target-signal-to-background-noise ratio are selected as the input to the stimulating means of both ear units; and wherein, if the difference in the target-signal-to-background-noise ratio is between said first threshold value and a second pre-defined threshold value, audio signals are transmitted from that one of the ear units at which the captured audio signals have a better target-signal-to-background-noise ratio to the other one of the ear units and a mixture of the transmitted audio signals and the audio signals captured at that one of the ear units at which the captured audio signals have the better target-signal-to- background-noise ratio are selected as the input to the stimulating means of that one of the ear units.

25. A system for providing binaural hearing assistance to a user, comprising:

a right ear unit which is to be worn at a right side of a user's head and which comprises a microphone arrangement for capturing audio signals at the right ear unit and means for stimulating a user's right ear, a left ear unit which is to be worn at the left side of the user's head and which comprises a microphone arrangement for capturing audio signals at the left ear unit and means for stimulating a user's left ear, means for determining a difference in the target-signal-to-background-noise ratio of the audio signals captured at the right ear unit and the audio signals captured at the left ear unit;

means for exchanging audio signals between the right ear unit and the left ear unit according to the determined difference in the target-signal-to-background-noise ratio, means for selecting, as a function of the determined difference in the target-signal-to-background-noise ratio, as input to each of the stimulating means at least one of the audio signals captured at the respective ear unit, the audio signals received from the other one of the ear units, and mixtures thereof; and wherein the exchanged audio signals are delayed by 0.5 to 5 ms relative to the ear unit receiving the exchanged audio signals;

wherein, if the difference in the target-signal-to-background-noise ratio exceeds a first pre-defined threshold value, audio signals are exchanged from that one of the ear units at which the captured audio signals have a better target-signal-to-background-noise ratio to the other one of the ear units and the audio signals having the better target-signal-to-background-noise ratio are selected as the input to the stimulating means of both ear units; and wherein, if the difference in the target-signal-to-background-noise ratio is between said first threshold value and a second pre-defined threshold value, audio signals are exchanged from that one of the ear units at which the captured audio signals have a better target-signal-to-background-noise ratio to the other one of the ear units and a mixture of the exchanged audio signals and the audio signals captured at that one of the ear units at which the captured audio signals have the better target-signal-to-background-noise ratio are selected as the input to the stimulating means of that one of the ear units.

26. The system of claim 25, wherein each ear unit is a hearing aid.

27. The system of claim 25, wherein each microphone arrangement comprises at least two spaced apart microphones.

28. The system of claim 25, wherein each stimulating means comprises a loudspeaker.

29. The system of claim 25, wherein the means for exchanging audio signals comprises means for establishing a wireless audio link between the ear units.

30. The system of claim 25, wherein each ear unit comprises means for determining the target-signal-to-background-noise ratio of the audio signals captured at that ear unit, and wherein the ear units comprise means for exchanging information regarding the determined target-signal-to-background-noise ratio of the audio signals captured at each of the ear units.

31. The system of claim 25, wherein each ear unit comprises means for determining the target-signal-to-background-noise ratio of the audio signals captured at that ear unit and for determining the target-signal-to-background-noise ratio of the audio signals received from the other one of the ear units.

32. The system of claim 25, wherein the selecting means is included in each of the ear units.

33. The system of claims 25, wherein the means for determining the difference in the target-signal-to-background-noise ratio are included in each of the ear units.

34. The system of claim 30, wherein each means for determining the target-signal-to-background-noise ratio of the audio signals is optimized with regard to typical spectra and typical time domain signals of the target signal.

35. A system for providing hearing assistance to a user, comprising:

a right ear unit which is to be worn at a right side of the user's head and which comprises a microphone arrangement for capturing audio signals at the right ear unit, and a left ear unit which is to be worn at a left side of the user's head and which comprises a microphone arrangement for capturing audio signals at the left ear unit, with one of the right ear unit and the left ear unit comprising means for stimulating a user's respective ear, means for determining a difference in the target-signal-to-background-noise ratio of the audio signals captured at the right ear unit and the audio signals captured at the left ear unit;

means for transmitting, according to the determined difference in the target-signal-to-background-noise ratio, audio signals from that one of the ear units not comprising stimulating means to the that one of the ear units comprising the stimulating means, wherein the transmitted audio signals are delayed by 0.5 to 5 ms relative to the ear unit receiving the transmitted audio signals, means for selecting, as a function of the determined difference in the target-signal-to-background-noise ratio, as input to the stimulating means at least one of the audio signals captured at the respective ear unit, the audio signals received from the other one of the ear units, and mixtures thereof;

wherein, if the difference in the target-signal-to-background-noise ratio exceeds a first pre-defined threshold value, audio signals are transmitted from that one of the ear units at which the captured audio signals have a better target-signal-to-background-noise ratio to the other one of the ear units and the audio signals having the better target-signal-to-background-noise ratio are selected as the input to the stimulating means of both ear units; and wherein, if the difference in the target-signal-to-background-noise ratio is between said first threshold value and a second pre-defined threshold value, audio signals are transmitted from that one of the ear units at which the captured audio signals have a better target-signal-to-background-noise ratio to the other one of the ear units and a mixture of the transmitted audio signals and the audio signals captured at that one of the ear units at which the captured audio signals have the better target-signal-to-background-noise ratio are selected as the input to the stimulating means of that one of the ear units.

* * * * *

UNITED STATES PATENT AND TRADEMARK OFFICE

CERTIFICATE OF CORRECTION

PATENT NO. : 8,532,307 B2
APPLICATION NO. : 12/525060
DATED : September 10, 2013
INVENTOR(S) : Derleth et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 973 days.

Signed and Sealed this
Fifteenth Day of September, 2015

Michelle K. Lee

Michelle K. Lee
*Director of the United States Patent and Trademark Office*